United States Patent [19]

Kirchner-Carl

[11] Patent Number: 4,573,741

[45] Date of Patent: Mar. 4, 1986

[54] FURNITURE STRUCTURAL COMPONENT

[76] Inventor: Angelika Kirchner-Carl, Waldstrasse 16, D-8644 Pressig, Fed. Rep. of Germany

[21] Appl. No.: 547,969

[22] Filed: Nov. 2, 1983

[30] Foreign Application Priority Data

Nov. 4, 1982 [DE] Fed. Rep. of Germany ..... 3240783

[51] Int. Cl.[4] ..... A97C 7/02

[52] U.S. Cl. ..... 297/452; 5/431; 267/81; 297/DIG. 1

[58] Field of Search ..... 297/452, DIG. 1, DIG. 2, 297/455; 5/431; 267/81, 83, 75, 131, 142, 147; 428/81, 913

[56] References Cited

U.S. PATENT DOCUMENTS

| | | | |
|---|---|---|---|
| 2,415,765 | 2/1947 | Schmidt | 267/81 X |
| 2,459,758 | 1/1949 | Flint | 267/83 |
| 3,519,530 | 7/1970 | Struble, Jr. | 428/913 X |
| 4,082,256 | 4/1978 | Mandusky | 267/81 |
| 4,371,575 | 2/1983 | Kerk et al. | 428/81 |
| 4,415,147 | 11/1983 | Biscoe | 297/452 |

*Primary Examiner*—James T. McCall

*Attorney, Agent, or Firm*—Finnegan, Henderson, Farabow, Garrett & Dunner

[57] ABSTRACT

A structural furniture component particularly for chairs, couches and the like comprising at least one self-supporting metal grid envelope the surfaces of which are covered by a shrink foil shrunk thereonto. This construction permits the metal grid envelope to serve as a material-saving displacement element in a furniture component, a static carrying or shape retaining element in the furniture component as well as resilient element in certain areas of the furniture component.

28 Claims, 12 Drawing Figures

FURNITURE STRUCTURAL COMPONENT

DESCRIPTION

Figure 1:
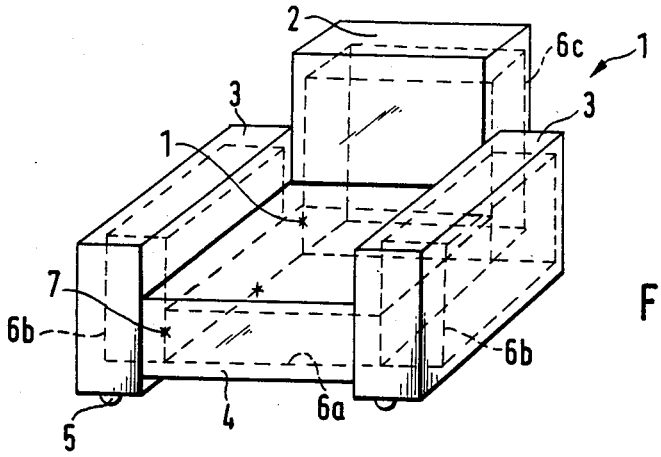

The invention relates to a structural furniture component.

The manufacture of furniture pieces consisting of synthetic foam material throughout requires an excessive amount of the expensive material. It is therefore customary to provide hollow spaces or voids filled with stiffening static structures formed of wood, plastics or metal. These structures are relatively expensive, as they have to be individually manufactured to required dimensions. The application of the foamed layers to these stiffening structures is rather difficult, even if the structures are embedded in foam formed in situ. The manufacture of other furniture components comprising a static base structure covered with foam material or other upholstery layers requires not only the employ of skilled labour but also a large amount of uneconomical manual work. In addition, certain portions of the base structure frequently have to be resilient to obtain desired resiliency in the furniture component (spring core), which also requires expensive and time-consuming operations. The fabric covering of the furniture piece as well as the upholstery layers are usually sewn on or secured by means of staples or pins. These operations are cumbersome and time-consuming and require special equipment and skilled labour. Generally it can be said that these types of furniture components intended for inclusion in a piece of furniture are relatively cumbersome and expensive as regards their manufacture and assembly, and that these structures have always to be specially harmonized with the type of the particular piece of furniture.

It is therefore an object of the invention to provide a structural furniture component which is of similar appearance and may be employed in the same manner as known structures of this kind, while being less cumbersome and expensive as regards its manufacture.

In accordance with the invention this object is attained, irrespective of the type and shape of the structural furniture component or of a piece of furniture made with such component, and irrespective also of whether it is intended to save material for the structural component, to provide a static base structure or to achieve predetermined resiliency properties, by providing a structural furniture component comprising at least one self-supporting metal grid envelope or structure, which is simple and inexpensive as regards its manufacture and may be universally adapted, covered with a shrunken plastic foil or film to any given requirements. The grid envelope may practically be formed, and preferably be prefabricated, in any shape or size and with any desired properties, depending on the intended use of the structural furniture component or the furniture piece made by the component.

An important aspect of the invention is that the hollow interior or void of the grid envelope covered with the shrunk foil contributes to the desired saving of upholstery material or foam material.

Alternatively to, or in combination with the above , the grid envelope covered with the shrunk foil forms the static base structure or the reinforcement of a structural furniture component or a piece of furniture made from the component. The grid envelope replaces the formerly required rigid base structure and is particularly well suited to meet any requirements as to stability, rigidity, weight and shape.

A further aspect of importance as an alternative to or in combination with the above is that a spring-function may be achieved by suitable configuration of the grid envelope and proper selection of the shrinkable foil covering the same and shrunk thereonto, it being then possible—as already explained—to have the grid envelope serve static or void-filling functions.

The void-filling or displacement function, the static function and the spring function can be carried out particularly well by having shrunken foil enclosing all sides of the grid envelope. Due to its overall tensioned connection with the grid envelope, the shrunk foil forms a static compound structure with the envelope, thereby increasing the resiliency of its flat surfaces. The foil additionally prevents the skeleton of the grid envelope from making itself annoyingly felt from the exterior, even if the grid envelope is only covered with a thin upholstery layer. The shrink foil may further be used to secure upholstery or foam layers to the grid envelope and permits the application of modern techniques such as in situ foaming, adhesively attaching or otherwise connecting the elements of the structural components to one another. It is of course also possible to employ the grid envelope covered with the shrunk foil directly as the base structure of the structural furniture component which may then be covered with upholstery layers or foam layers rigidly or loosely attached thereto.

The grid envelope of the structural component can be made simply by bending a grid web section formed of interconnected rectilinear longitudinal and transverse rods. In this way, the grid envelope may be formed to practically any geometric shape by the employ of extremely simple equipment or machinery. The shrink foil, due to its elastic properties, is able to exactly conform to the shape of the grid envelope in any case.

In a further important aspect of the invention the open ends of the grid envelope may be left free or may also be closed by the shrunk foil. In an embodiment, in which the grid envelope is contained in a furniture component and subjected therein to loads in all imaginable directions, the open ends may also be designed to be load-supporting in the same manner as the other surface portions of the grid envelope, namely, with longitudinal and transverse rods.

A further low-cost embodiment of the invention is achieved by constructing the envelope of a plurality of web sections. This offers the advantage that grid web sections having different properties or formed of different materials may be combined to form the grid envelope to convey thereto different load-supporting properties under loads acting in different directions.

A further advantageous aspect of the invention is achieved by covering the envelope on both its interior and exterior sides with the foil. The covering of the surfaces of the grid envelope on both sides results not only in a particularly high strength for these surfaces, combined with a suitable resiliency, but also desirable protection for the longitudinal and transverse rods against exterior influences such as moisture or the like.

The resiliency of the flat sides of the grid envelope as well as the stability of the shape thereof may further be improved by welding or otherwise connecting the interior foil to the exterior foil in the open areas between the rods of the envelope. Then the loads acting on the twin-layered foil in each open area are directly transmitted to the surrounding longitudinal and transverse rods.

Particular advantages are also offered by constructing the grid envelope of structural steel matting that is commercially available in various rod thicknesses, rod spacings and area unit weights, and is also rather inexpensive. Spring steel wire mesh grid material also can be used, which is relatively expensive and may be better suited for certain purposes, particularly for obtaining improved spring properties. It is of course also possible to employ combinations of these two types of metal grid structures for one and the same grid envelope.

A further advantageous embodiment of the invention is obtained by interconnecting the upper and lower faces of the grid envelope with yieldable grid web sections. This achieves a spring action between the upper face and the lower face, so that the grid envelope can take over the function of the hitherto employed expensive spring core. At the same time, however, it is still able to act as a space-filling displacement body and as a static portion of the structural component or the piece of furniture. The shrink foil shrunk onto the grid envelope is in this case effective to impart a bias to the grid envelope, whereby the spring action thereof is further improved. If this grid envelope is covered with the shrink foil on all sides, the enclosed air may also be made use of for improving the spring action.

Figure 2:
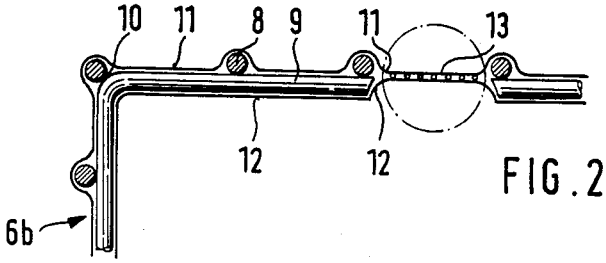
Figure 3:
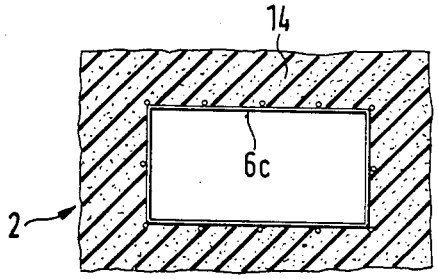
Figure 4:
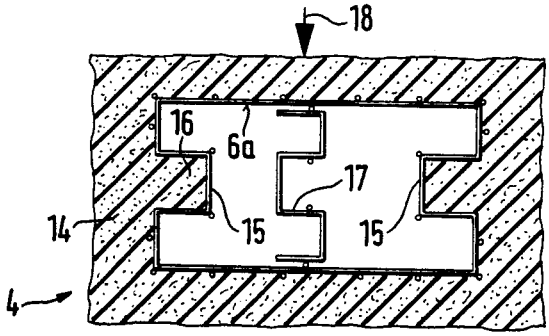
Figure 5:
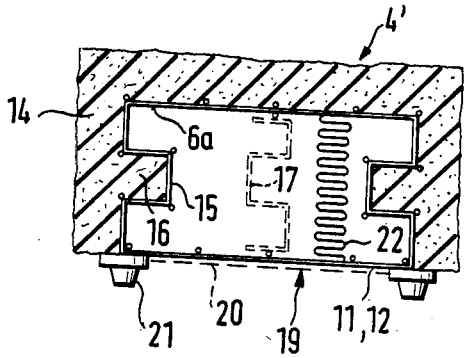
Figure 6:
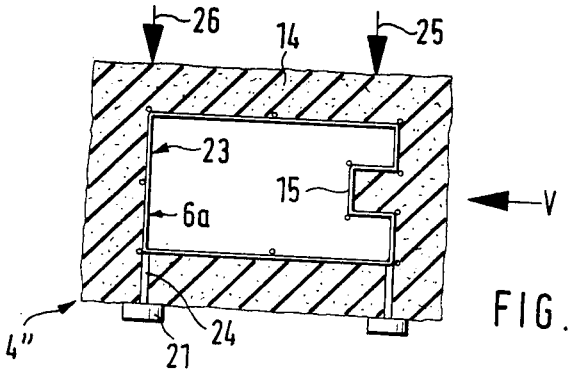
Figure 7:
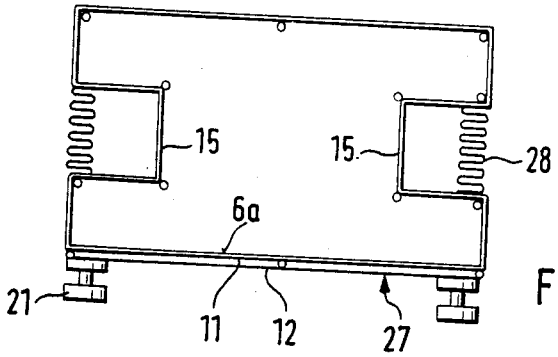
Figure 8:
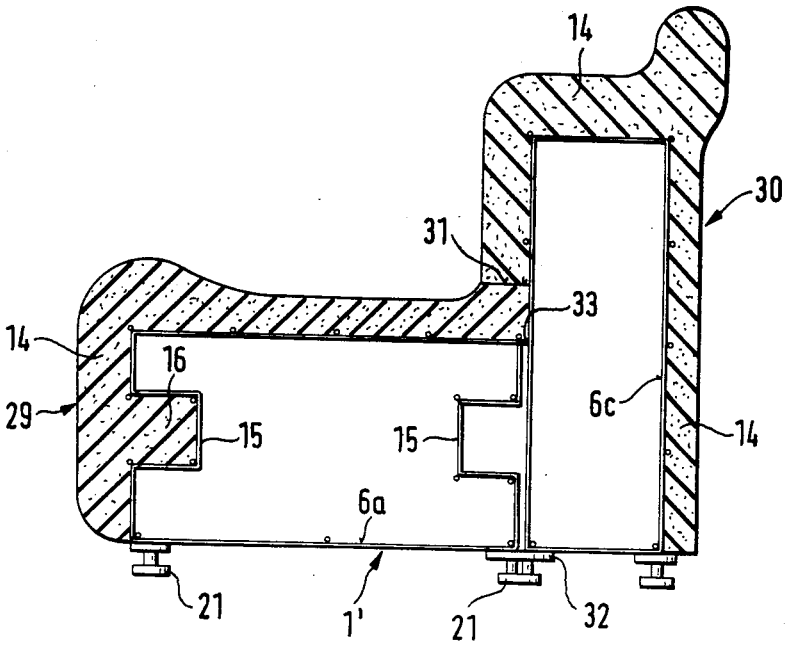
Figure 9:
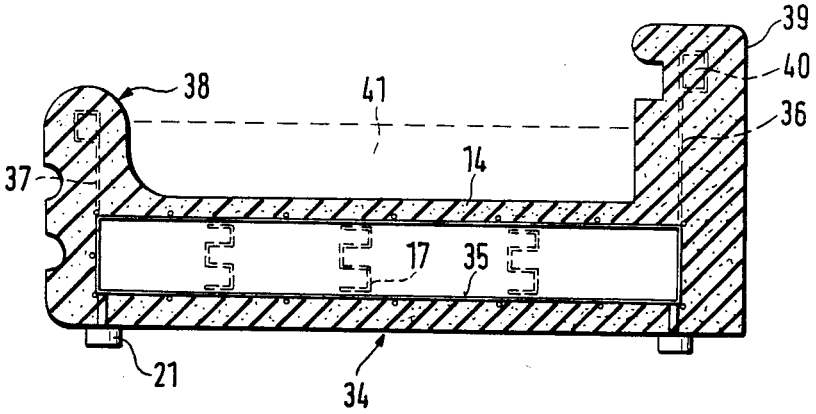
Figure 10:
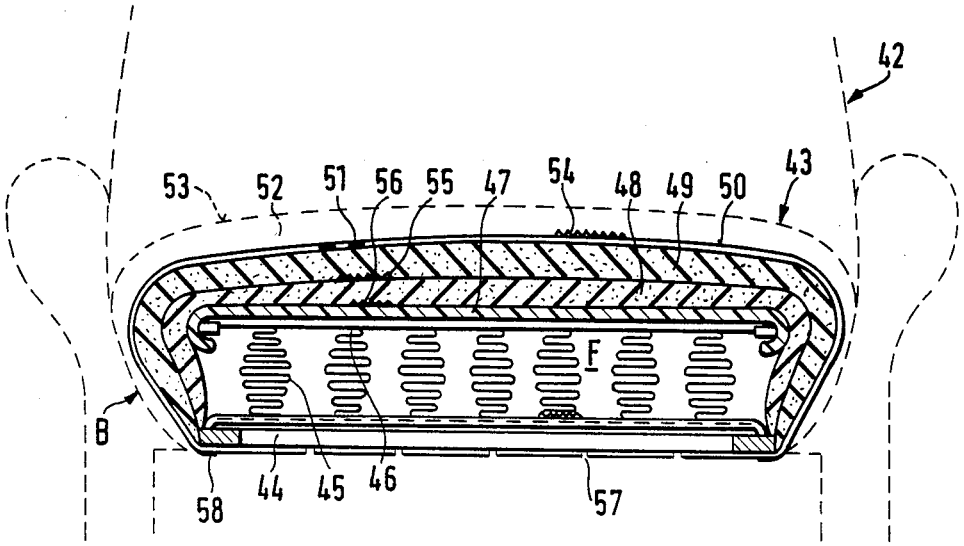
Figure 11A:
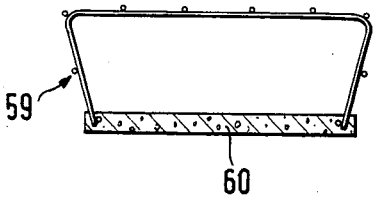
Figure 11B:
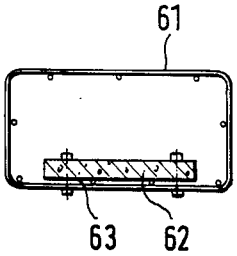

Preferred embodiments of the invention shall now be described with reference to the accompanying drawings, wherein:

FIG. 1 is a perspective view of a seating furniture piece comprising a plurality of components, FIG. 2 is an enlarged sectional view of a portion of a grid envelope employed in the furniture components of the FIG. 1 embodiment, FIG. 3 is a cross-sectional view of a furniture component, FIG. 4 is a cross-sectional view of a different embodiment of a structural furniture component, FIG. 5 is a cross-sectional view of a further embodiment of a structural furniture component, FIG. 6 is a cross-sectional view of a still further embodiment of a furniture component, FIG. 7 is a cross-sectional view of yet another embodiment of a structural furniture component, FIG. 8 is a cross-sectional view of a seating furniture piece, FIG. 9 is a cross-sectional view of a lying furniture piece, FIG. 10 is a cross-sectional view of a further embodiment of a structural furniture component, and FIGS. 11*a* and 11*b* are diagrammatical cross-sectional views of modified grid envelopes.

A seating furniture piece 1 as shown in FIG. 1 consists of a plurality of components, namely, a backrest component 2, armrest components 3 and a seat component 4. Seating furniture piece 1 rests on legs 5. Included in the individual components are self-supporting grid envelopes 6*a*, 6*b*, 6*c* shown in dotted lines in FIG. 1. The construction of envelopes 6*a*, 6*b*, 6*c* is shown in detail in FIG. 2. The grid envelopes serve as void-filling displacement bodies with the purpose of serving as strengthening members defining and maintaining the shape of the furniture components. Grid envelope 6*a* in component 4 additionally acts in the manner of a conventional spring core by resiliently and compressively supporting the upholstery of the seat surface. Grid envelope 6*c* might also be of a resiliently yieldable construction at least in the upper portion of backrest component 2. The individual grid envelopes 6*a*, 6*b* and 6*c* are connected to one another at diagrammatically indicated connection points 7 so as to form a statically stable load-supporting base structure or frame for seating furniture piece 1.

FIG. 2 serves to explain the construction of grid envelope 6*b* in detail. Grid envelope 6*b* may for instance consist of a grid web section having longitudinal and transverse rods 8 and 9, respectively, connected to each other at intersections 10. This grid web may for instance be a conventional structural steel grid. The longitudinal and transverse rods 8 and 9, respectively, may also consist of spring steel wire. Preparatory to forming grid envelope 6*b*, a grid web section of predetermined size in its flat state is covered on both sides with a shrunk shrink foil or film 11, 12, the two foils being welded or adhesively or otherwise connected to one another at the open areas between longitudinal and transverse rods 8, 9. As shown, shrink foils 11 and 12 are in intimate contact with longitudinal and transverse rods 8 and 9, respectively, so as to form a unitary compound structure therewith. After the grid web section has been thus covered, it is bent to the shape of grid envelope 6*b*, i.e. to an open-ended tubular configuration of square or rectangular cross-sectional shape. The open ends may be closed by a further shrink foil (not shown) in the form of a cap adhesively attached or welded to shrink foil 11, so that grid envelope 6*b* is closed on all sides. For further stabilizing the shape of grid envelope 6*b*, if required, the open ends may also be closed with suitable grid web portions.

In place of the two types of grid envelopes 6*a* and 6*b* for the armrest components 3 and seat component 4, it would also be possible to employ a single grid envelope formed by suitably bending a grid web section in a single operation. Furniture base structures of more intricate configuration, such as the one shown in FIG. 1, are preferably assembled, however, of a plurality of for instance cubic or box-shaped grid envelopes, as this would only require a limited number of such grid envelope sizes and shapes adapted to be selectively combined with each other, whereby manufacture and storage is greatly facilitated.

The seating furniture piece 1 might also be formed in one piece of a hard foam, for instance polystyrol, in which case the individual grid envelopes would also act as void-filling and stiffening members.

FIG. 3 shows a cross-sectional view of a furniture component, for instance backrest component 2 of FIG. 1. Grid envelope 6*c* is completely enclosed in a foam material or upholstery layer 14. Layer 14 may for instance be formed in situ of a foam material, or may consist of pre-cut foam material sections adhesively attached to the grid envelope and to each other. In this case grid envelope 6*c* serves as a void-filling or hollow displacement body for saving material. In addition grid envelope 6*c* may be used to improve the shape-retaining properties of furniture component 2, which is of particular importance in the case of foam materials, as these are not sufficiently rigid by themselves. In the case of hard foams, this function of grid envelope 6*c* is less important, as hard foams are sufficiently rigid by themselves. On the other hand, in the case of furniture components formed solely of such hard foam material, the low weight thereof is often considered disadvantageous. Furniture components formed mainly or solely of hard foams often show a tendency to tip over or slide out of position. To avoid this tendency, grid envelope 6c is effective to increase the weight of the furniture component and thus of a piece of furniture including this component. The manufacture of the furniture component is particularly simple as the foam material adheres particularly well to the shrink foil without the grid envelope requiring any particular preparation. On the other hand, the attachment of coverings or supplementary components to the grid envelope is also greatly simplified, if the furniture component is to be manufactured with such additional components. This is because such additional components may be simply adhesively attached, which is particularly effective in view of the flat and smooth surface of the extremely durable foil.

Shown in a cross-sectional view in FIG. 4 are the structural details of seating component 4 in FIG. 1. In addition to its function as a displacement body, grid envelope 6a here also serves the purpose of imparting a desired compressive resiliency to seat component 4, which is of particular importance if grid envelope 6a is coverd with or enclosed in a foam layer 14, as it prevents the foam layer 14 on the seat surface from sagging. The two lateral faces of grid envelope 6a are formed with inwardly offset portions 15 filled with foam material 16 and extending over the full length of said grid envelope. Particularly if grid envelope 6a is formed, at least in its lateral portions, of a spring steel grid material, the inwardly offset portions 15 are effective to improve the compression resilience in the direction of arrow 18, so that the grid envelope 6a then acts as a conventional spring core. The longitudinally extending and continuous inwardly offset portion 15 permits the grid envelope to resiliently yield to loads applied thereto in a predetermined direction without loosing the capability of returning to its original shape, so that the grid envelope can serve as its static and possibly also void-filling displacement functions in the structural component, in addition to a spring function. If the grid envelope 6a is formed of a lighter steel wire grid web, it may be preferred to additionally insert a supplementary component 17 therein, such component being advantageously also made of a metal grid section bent to a U-shaped, zig-zag or meander configuration. Preferably grid envelope 6a is located within component 4 so that its open end extending in the plane of FIG. 4 faces forwards in the seat component 4 of FIG. 1. As mentioned, grid envelope 6ais covered with a shrink foil to which foam layer 14 adheres particularly well. The open end of grid envelope 6a may also be closed by a shrink foil, if so required. The upholstery layer 14 surrounding grid envelope 6a may either be formed in situ of a foam material, or may consist of pre-cut foam material sections or conventional upholstery layers adhesively attached to the shrink foil.

FIG. 5 shows a modification of the furniture component 4' useful as a seat component for a furniture piece as in FIG. 1, or as a component for a stool, a couch or the like. In this case, grid envelope 6 acts not only as a displacement body with the purpose of material savings, but its outer surfaces, with the exception of the bottom surface, are only covered with thin foam layers which may be formed in situ on the shrink foil of grid envelope 6a. Because of the inwardly offset portions 15 filled with foam material 16, grid envelope 6a has desirable spring action and at the same time forms the static base structure of furniture component 4', to which it imparts form retention capability and stability. In this embodiment the bottom surface of grid envelope 6a is formed without a covering foam or upholstery layer. The bottom surface may even be left without the covering shrink foils 11 and 12, so that its interior opens outwards. This opening may then be covered with a fabric cover 20. Grid envelope 6a is formed with legs 21 or with connection members for the attachment of such legs. Also envisaged is the provision of connecting members for connecting furniture component 4' to a similar or complementary component.

Shown in dotted lines interiorly of grid envelope 6a is an additional support member 17 serving to improve the springiness of furniture component 4'. In addition to or in place of one or several such support members 17 there may be provided a number of helical springs 22 within grid envelope 6 between its upper and lower face.

FIG. 6 shows a sectional view of a further furniture component 4'', which the shape-imparting static base structure formed by a grid envelope 6a is fully enclosed in an upholstery or foam layer. Grid envelope 6a is formed with a rectilinear rear wall 23, whereby the resilient compressibility of the grid envelope and the furniture component is substantially reduced in this area. The front wall is again formed with an inwardly offset portion 15 filled with foam material, so that the furniture component is resiliently compressible in this area. Rigidly attached to the bottom side of grid envelope 6a during its manufacture are connecting members 24 for the attachment of legs 21 or the like supporting the furniture component on the ground.

In the case of furniture pieces of foam materials, it is particularly difficult to affix connection members or legs in such a manner that they remain durably attached and are able to transmit loads to the carrying structure of the piece of furniture. The metal grid envelope permits such connection members to be affixed thereto in a particularly simple and still extremely durable manner, preferably during manufacture of the grid envelope itself, which may then be employed as a fully prefabricated unit in the manufacture of furniture. This greatly simplifies the final manufacture of furniture pieces and components therefor. Under a load acting in the direction of arrow 26, furniture component 4'' is relatively rigid, while resiliently yielding to loads applied in the direction of arrow 25. Furniture component 4'' may for instance be employed as or in a couch, a davenport or the like, in which case the side having the inwardly offset portion would be facing forward. In this embodiment, grid envelope 6a acts as a displacement body, as a shape-imparting base structure and as a resiliency-imparting structure.

FIG. 7 shows an alternative embodiment of a furniture component 27 consisting of a grid envelope 6a covered with shrink foils 11, 12 and resting on legs 21 without being provided with any upholstery or foam layers or the like. The righthand and lefthand vertical sides of the basically cubic furniture component 27 are each formed with an inwardly offset portion 15 having a longitudinal row of helical springs 28 located therein. This allows the spring action of the structural furniture component in the area above the inwardly offset portion to be accurately predetermined. Furniture component 27 has inherent shape-retaining properties while also being resilient. It could of course also be provided with interior support members 17 or helical springs 22 as in FIG. 5. Furniture component 27 may be provided with loosely attached or adhesively affixed upholstery or foam layers if so required. It may also be connected to similar or complementary furniture components for forming a larger support surface for a mattress or the like.

In this connection it is to be noted that grid envelope 6a does not necessarily have to be covered with a shrink foil on both sides, it being also possible to provide only an inner or an outer covering of this kind. The shape of the inwardly offset portions 15 may also be different from the one shown, for instance a U-shaped or zig-zag configuration. In this embodiment, furniture component 27 thus essentially forms a shape-retaining, although resilient spring core adapted on inclusion in a piece of furniture to additionally act as a displacement body.

FIG. 8 shows a cross-sectional view of a seating or lie-down piece of furniture 1' having a static, void-filling and at the same time partially springy base structure composed of two grid envelopes 6a and 6c connected to one another at connection points 32 and 33. Grid envelope 6a is formed with the already described inwardly offset portions 15, the forward facing one of which is filled with foam material 16. Grid envelope 6c has the shape of a rectangular box without pronounced resilient properties.

The bottom side of the base structure formed of the two grid envelopes 6a and 6c is left uncovered, while the remaining faces are covered with upholstery or foam layers 14. The upholstery may be foamed in situ or may consist of pre-cut foam slabs connected to one another by the intermediate of a foil 31 or abutting one another end-to-end, and adhesively or otherwise attached to the shrink foils of grid envelopes 6a and 6c over the remaining areas. Furniture component 1' could also be a seating element for selective connection to similar seating elements, in which case the lateral faces of each such seating element are preferably free of upholstery layers, so that they can be directly connected to one another to form a couch or a corner seat of a plurality of such elements. The base structure of a corner seat of this type would then consist of a plurality of possibly identical grid envelopes, with two standard sizes of grid envelopes, for instance 6a and 6c being sufficient.

FIG. 9 shows a cross-sectional view of a so-called french bed 34, the carrying base structure of which is formed by a grid envelope 35 of elongated box-shaped configuration, the remainder of this piece of furniture consisting essentially of a foam material. Grid envelope 35 includes a plurality of interior support elements 17 and/or helical springs to give it the desired resiliency. The bottom side of grid envelope 35 is again provided with connecting members or legs 21 which in this case are embedded in the foam material 14 fully enclosing grid envelope 35.

As further shown in dotted lines, grid envelope 35 is formed with substantially flat projecting portions, formed by suitably bending selected portions of the grid material or affixed thereto subsequent to formation of the envelope. These portions form stiffener elements 36, 37 for the upstanding foot and head end walls 38 and 39, respectively, of bed 34, and are completely embedded therein. The ends of elements 36, 37 may be formed as box-shaped profiles 40 for improving their bending strength and improving adherence of the foam material.

Grid envelope 35 may readily be designed so as to provide resilient properties similar to those of a conventional mattress, while imparting the desired shape-retaining properties to the piece of furniture 34. In this case the user would rest directly on the top surface between head and foot end walls 38 and 39, respectively. If on the other hand, grid envelope is of a more rigid construction, a mattress 41 may be disposed in the depression between head and foot end walls.

If grid envelope 35 were formed of spring steel wire or meshed grid material covered with shrink foil, it could also be used as a spring core for a mattress in place of a conventional spring core. It could further be included in a foam mattress as a shape-retaining and resilient base structure thereof, in which case it would preferably be fully embedded in the foam material.

Grid envelopes of the type described may further be used as the carrying base structure for other furniture components or furniture accessories such as bedside tables, trunks, stools, cabinets or the like. For use as or in a bedside table, the grid envelope is left without the covering shrink foil on at least one side, and provided with upholstery layers or exterior decorative layers. The open side may additionally be provided with an openable door giving access to the interior of the bedside table.

FIG. 10 shows a cross-sectional view of a furniture component B adapted to be used in the manufacture of furniture as a prefabricated intermediate product. Furniture component B is intended to form the seat portion 43 of a seating furniture piece 42. It contains a conventional spring core F supported on a support frame 44 and containing an arrangement of helical springs 45 attached to the lower face of an upper support frame 46. Upper support frame 46 is covered with a ductile-elastic cover 47 again covered with upholstery layers 48, 49, for instance foam layers. The above described components are enclosed in a shrunken shrink foil 50 securing spring core F on frame 44 as well as cover 47 and upholstery layers 48, 49 in their respective positions. The interior surface of foil 50 may be provided with an adhesive coating 51, for instance a hot melt adhesive, adapted on shrinking the foil under the action of heat to form a connection between foil 50 and the topmost upholstery layer 49. The top surface of the foil is covered by an intermediate layer 52 of for instance Vlieseline, the outer surface of which is finally covered with the fabric covering 53. For reliably securing intermediate layer 52 in position, foil 50 may have a textured upper surface as shown by naps 54. The inner side of foil 50 may also be provided with a similarly textured surface. Between upholstery layers 48, 49 and cover 47 there are also provided adhesive layers or coatings 55 and 56, respectively, which layers are not, however, indispensable. Foil 50 may be provided with perforations 57 at least at the bottom side, so that the air displaced by compression of the spring core is able to escape and is subsequently readmitted. Fabric cover 53 may be adhesively secured to foil 50 as indicated at 58, so that the assembly of furniture component B does not require any tacking, sewing and/or stapling operations.

In all embodiments of the above described grid envelopes, the shrink foil is either a conventional smooth and thin plastic sheet or film or a foamed shrink foil, i.e. a shrink foil formed of a foamed material. A foil of this type, which may also be used as foil 50 in FIG. 10, offers considerable advantages over conventional smooth foils with regard to "grip" and the avoidance of the so-called drum effect making itself known by an annoying noise. In addition, this type of foil is more resistant to damage and conducive to particularly good adherence of upholstery or foam layers applied thereto.

In a simplified embodiment of furniture component B, intermediate layer 52 may be eliminated, and fabric cover 53 be directly applied to the surface of foil 50, which in this case is preferably a foamed shrink foil.

FIGS. 11*a* and 11*b* show diagrammatic cross-sectional views of grid envelopes 59 and 61 specifically intended for light-weight pieces of furniture made of soft or hard foam materials. The low weight of such furniture is often considered a disadvantage, as it results in a too high center of gravity, whereby the furniture pieces tend to tip over or to slide out of position. Grid envelopes 59 and 61 may be incorporated in furniture of this type for the purpose of saving material while ensuring the requisite shape-retaining properties irrespective of the material saving. Grid envelope 59 has the shape of an inverted u-shaped trough with downwardly converging sidewalls embedded in a ballast body 60, for instance a concrete slab. The provision of ballast body 60 results in a low center of gravity and thus an improved resistance against tipping or sliding of a furniture component or piece of furniture including grid envelope 59.

A simplified embodiment is represented by grid envelope 61, wherein ballast body 62 is secured to the bottom portion of envelope 61 by means of fastener elements 63. In this case, the ballast body results in improved behavior of a piece of furniture or a furniture component with regard to tipping over and sliding out of position.

I claim:

1. A structural component forming an interior part of a piece of upholstered furniture comprising a plurality of longitudinal and transverse metal rods interconnected at essentially right angles to form a self-supporting grid-like envelope having a hollow interior and a shrunken plastic foil covering and adhered to at least the outer surfaces of the grid envelope.

2. The structural component of claim 1, wherein said grid envelope covered with said shrink foil is at least partially resilient to provide a spring core for the piece of furniture.

3. The structural component of claim 1 in which the shrunken foil encloses said grid envelope on all sides.

4. The structural component of claim 1 in that said grid envelope is formed from a bent grid web section formed of interconnected longitudinal and transverse rods.

5. The structural component of claim 4, in which the envelope is tubular in shape having open ends.

6. The structural component of claim 1 in which the grid envelope is composed of a plurality of grid web sections formed of interconnected longitudinal and transverse rods.

7. The structural component of claim 1 in which the grid envelope is composed of a plurality of grid web sections formed of interconnected longitudinal and transverse rods.

8. The structural component of claim 1 in which both inner and outer surfaces of said grid envelope are covered with the shrunken foil.

9. The structural component of claim 8 in which the inner foil adheres to the outer foil in the free areas between said longitudinal and transverse rods.

10. The structural component of claim 1 in which the grid envelope is formed of a structural steel mat.

11. The structural component of claim 1 in which the grid envelope is formed from spring steel rods.

12. The structural component of claim 1 in which the grid envelope is of approximately box-shaped configuration, the upper face and the lower face of said grid envelope being interconnected by a yieldable grid web section bent into a non-linear configuration.

13. The structural component of claim 12 including a yieldable grid web section located in the interior of said grid envelope.

14. The structural component of claim 13, in which the interior grid web sections is bent into a u-shaped, zig-zag-fashion configuration.

15. The structural component of claim 12, in which at least one lateral face of the envelope has at least one continuous inwardly offset portion extending over the full length of said face.

16. The structural component of claim 15, including helical springs in said inwardly offset portion.

17. The structural component of claim 1 including helical springs in the interior of said grid envelope between its upper and lower face.

18. The structural component of claim 1 in which said grid envelope covered with said shrunk foil is at least partially embedded in a synthetic foam material.

19. The structural component of claim 18 in which at least one lateral face of the envelope has at least one continuous inwardly offset portion extending over the full length of said face, said portion being filled with and integral with foam material covering the outer surfaces of the envelope.

20. The structural component of claim 1 in which the grid envelope has connector members for attaching ground-support legs for the piece of furniture.

21. The structural component of claim 1 including a plurality of grid envelopes connected to one another to form the structural component of said piece of furniture.

22. The structural component of claim 1 in that said grid envelope has at least one surface not covered with shrink foil.

23. The structural component of claim 1 in which the grid envelope is formed with additional flat projecting portions serving a stiffening or shaping function to the piece of furniture made from the component.

24. The structural component of claim 1 in which the shrink foil includes foam material.

25. The structural component of claim 1 in which the shrink foil has perforations.

26. A structural component of claim 1 in which foam layers are adhesively secured to said grid envelope covered with said shrunk foil and secured in position by a further outer shrunk foil.

27. The structural component of claim 1 in that a weighted object is structurally integrated into said grid envelope.

28. A piece of upholstered furniture containing the structural component of claim 1.

* * * * *